United States Patent [19]

Stark

[11] Patent Number: 4,559,245

[45] Date of Patent: Dec. 17, 1985

[54] PAINT SHIELD HOLDER AND SHIELDING METHOD

[76] Inventor: William C. Stark, 306 S. Almansor St., Alhambra, Calif. 91801

[21] Appl. No.: 526,500

[22] Filed: Aug. 25, 1983

[51] Int. Cl.[4] ..... B05D 1/32

[52] U.S. Cl. ..... 427/282; 427/421; 118/504; 29/450; 29/172; 24/558; 24/565

[58] Field of Search ..... 118/504, 503, 505, 301; 29/450, 172; 24/563, 545, 555, 557, 558, DIG. 9, 3 E, 3 J, 3 R, 67.3, 67.9, 67.11, 565, 553, 554; 427/282, 300, 421

[56] References Cited

U.S. PATENT DOCUMENTS

| | | | |
|---|---|---|---|
| D. 248,725 | 8/1978 | McClane | D8/14 |
| 314,769 | 3/1885 | Yeiser | 24/67.7 |
| 456,775 | 7/1891 | Prescott | 118/504 |
| 624,796 | 5/1899 | Hardin | 118/504 |
| 695,965 | 3/1902 | Taylor et al. | 118/504 |
| 757,937 | 4/1904 | Lukes | 24/67.7 |
| 799,873 | 9/1905 | Senge | 24/67.7 |
| 1,386,706 | 8/1921 | Hall | 118/504 |
| 1,434,903 | 11/1922 | Manning | 118/504 |
| 1,563,889 | 12/1925 | Zastrow | 118/505 |
| 1,621,008 | 3/1927 | Fricker | 24/563 |
| 1,675,286 | 6/1928 | Valkenburg | 24/563 |
| 1,693,098 | 11/1928 | Taylor | 24/DIG. 9 |
| 1,851,497 | 3/1932 | Darling | 15/257 R |
| 2,058,128 | 10/1936 | Brubach | 24/545 |
| 2,289,136 | 7/1942 | Matter | 91/65 |
| 2,290,472 | 7/1942 | Hendrick | 91/65 |
| 2,332,579 | 10/1943 | Kirby | 91/65 |
| 2,484,607 | 10/1942 | Cherem | 118/504 |
| 2,517,220 | 8/1950 | Lister | 91/65 |

(List continued on next page.)

FOREIGN PATENT DOCUMENTS

| | | |
|---|---|---|
| 581704 | 4/1944 | United Kingdom . |
| 1400406 | 7/1975 | United Kingdom . |

OTHER PUBLICATIONS

Product Literature for LDA 36 Paint Shields, Lloyd Detlofsen and Associates, Bellevue, Wash.

Stark, "Paint-Gun Injuries of the Hand" *The Journal of Bone and Joint Surgery,* vol. 49-A, No. 4, pp. 637-647, Jun. 1967.

*Consumer Reports,* Jun. 1978, p. 333.

Booth, "High Pressure Paint Gun Injuries" *Abstract,* vol. 62, No. 3, 1977.

Karaharju et al., "Angiography After Paint-Gun Injury of the Handia Case Report" *Injury,* vol. 9, pp. 66-67.

Silsby, "Pressure Gun Injection Injuries of the Hand," *The Western Journal of Medicine,* vol. 125, pp. 271-276, Oct. 1976.

Gillespie et al., "Airless Paint Gun Injuries: Definition and Management", *The American Journal of Surgery,* vol. 128, Sep. 1974, pp. 383-391.

*Primary Examiner*—Norman Morgenstern
*Assistant Examiner*—Bernard F. Plantz
*Attorney, Agent, or Firm*—Benoit Law Corporation

[57] ABSTRACT

Paint shield holders and shielding methods form a pair of planar sheets and an interconnecting resilient bight portion into a clip for receiving a planar edge portion of a paint shield between major surfaces which in area are a multiple of a cross-section of each planar sheet perpendicular to the major surfaces. The resilient clip is employed to bias the planar sheets at their major surfaces into frictional engagement with the contacted planar edge portion of the inserted shield. Instead of nuts, bolts or other fasteners, the mentioned frictional engagement is employed as the only agency at the major surfaces of the planar sheets for holding the planar edge portion of the shield in place upon mere manual insertion of the shield at the planar edge portion into the clip. An elongate handle is rendered selectively attachable to the clip by a manual first relative movement between the elongate handle and the clip, and alternatively detachable from the clip by a manual second relative movement between the elongate handle and the clip. A method of cutting or forming a resilient and lightweight solvent-proof cellular material for use as a reusable paint shield inhibits paint migration around a bifurcated shielding edge and reduces painter fatigue.

30 Claims, 2 Drawing Figures

U.S. PATENT DOCUMENTS

| | | | |
|---|---|---|---|
| 2,538,743 | 1/1951 | Alston | 91/65 |
| 2,545,638 | 3/1951 | Wheatley | 91/65 |
| 2,672,122 | 3/1954 | Kupec et al. | 118/505 |
| 2,693,785 | 11/1954 | West, Jr. | 118/504 |
| 2,805,013 | 9/1957 | Comfort | 24/545 |
| 2,842,093 | 7/1958 | O'Neill | 118/301 |
| 3,029,782 | 4/1962 | Eure | 118/505 |
| 3,276,806 | 10/1966 | Hansen | 24/563 |
| 3,330,253 | 7/1967 | Rowe, Jr. | 118/504 |
| 3,380,435 | 4/1968 | Wagner | 118/505 |
| 3,528,388 | 9/1970 | McLain | 118/504 |
| 3,536,041 | 10/1970 | Hill | 118/504 |
| 3,538,532 | 11/1970 | Shortino et al. | 15/230.11 |
| 3,693,589 | 9/1972 | Knox | 118/504 |
| 3,863,601 | 2/1975 | Eckart, Jr. | 18/505 |
| 3,942,472 | 3/1976 | McAllister | 118/504 |
| 4,051,808 | 10/1977 | Trupp | 118/504 |
| 4,085,703 | 4/1978 | Glowacki | 118/504 |
| 4,217,854 | 8/1980 | Brown | 118/504 |
| 4,235,192 | 11/1980 | Brubaker | 118/504 |
| 4,241,693 | 12/1980 | Shotwell | 118/504 |
| 4,248,914 | 2/1981 | McClane | 427/282 |
| 4,331,716 | 5/1982 | Stark | 427/282 |

PAINT SHIELD HOLDER AND SHIELDING METHOD

BACKGROUND OF THE INVENTION

1. Field of the Invention

The subject invention relates to paint shields, paint shielding methods, and handles and holders for paint shields 2. Disclosure Statement The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

The current proliferation of high-pressure spray guns among unskilled people, such as through purchase or rental from wholesale paint stores, is giving rise to various problems including serious hand injuries which are difficult to treat as, for instance, reported in an article by Cameron A. Gillespie, M.D., et al, entitled "Airless Paint Gun Injuries: Definition and Management," which appeared in THE AMERICAN JOURNAL OF SURGERY, Vol 128, Sept. 1974, pp. 383–391. Reference should also be had to an article by Herbert H. Stark, M.D on "Paint-Gun Injuries of the Hand," which appeared in THE JOURNAL OF BONE AND JOINT SURGERY, Vol. 49–A, No. 4, pp. 637–647, June 1967. As apparent from that article, high-pressure airless spray guns bring about serious and tragic injuries not readily preventable by existing safetey devices. Also, as apparent from CONSUMER REPORTS, June 1978, p. 333, the Consumer Product Safety Commission found many existing guards ineffective to provide the requisite protection. Moreover, general practitioners do not necessarily know how a spray gun injury should be treated, thereby increasing their danger, as apparent from ABSTRACTS, Vol. 62, No. 3, summarizing an article by Dr. C. M. Booth, entitled "High Pressure Paint Gun Injuries," from the British Medical Journal, 1333, 1977. Furthermore, spray gun injuries frequently are difficult to detect on admission of the patient, as noted in an article by Erkki 0. Karaharju and Pär Slätis, entitled "Angiography after Paint-Gun Injury of the Hand: a Case Report," which appeared in INJURY, Vol. 9, pp. 66–67, and in an article by John J. Silsby, M.D. entitled "Pressure Gun Injection Injuries of the Hand," and having appeared in THE WESTERN JOURNAL OF MEDICINE, 125: 271–276, Oct. 1976.

Traditional shields which require or by their form encourage the presence of the painter's hand at the shield, when the same is used on vertical walls or ceilings, obviously do nothing to alleviate the above mentioned problems This, for instance, applies to the wall protecting device disclosed in U.S. Pat. No. 695,965, by F. L. Taylor et al, issued Mar. 25, 1902, the paint shielding device shown in U.S. Pat. No. 3,330,253, by H. W. Rowe, Jr., issued July 11, 1967, the corner painting shield disclosed in U.S. Pat. No. 4,235,192, by T. G. Brubaker, issued Nov. 25, 1980, and the interior decorators' aid disclosed in British patent specification No. 1,400,406, published July 16, 1975.

Other paint shields have handles that are close to the work as to be incapable of effectively alleviating the above mentioned problems. This, for instance, applies to the wall protector of U.S. Pat. No. 456,775, by M. T. Prescott, issued July 28, 1891, the wall shield of U.S. Pat. No. 624,796, by R. L. Hardin, issued May 9, 1899, the paint guard disclosed in U.S. Pat. No. 1,386,706, by L. W. Hall, issued Aug. 9, 1921, the wall protector of U.S. Pat. No. 1,434,903, by C. V. Manning, issued Nov. 7, 1922, the painting tool disclosed in U.S. Pat. No. 1,851,497, by J. Darling, issued Mar. 29, 1932, the painting and cleaning guard of U.S. Pat. No. 2,517,220, by J. S. Lister, issued Aug. 1, 1950, the L-shaped wall protector of U.S. Pat. No. 2,538,743, by W. L. Alston, issued Jan. 23, 1951, the painting guide ruler of U.S. Pat. No. 3,536,041, by J. A. Hill, issued Oct. 27, 1970, the paint shield disclosed in U.S. Pat. No. 3,693,589, by J. W. Knox, issued Sept. 26, 1972, the paint and stain shield of U.S. Pat. No. 4,051,808, by W. Trupp, issued Oct. 4, 1977, the paint guide disclosed in U.S. Pat. No. 4,241,693, by A. M. Shotwell, issued Dec. 30, 1980, and the painting guard disclosed in British patent specification No. 581,704, by J. G., Talbot, dated Apr. 14, 1944.

Several shielding devices have been proposed in the past for use on windows, as may, for instance, be seen from U.S. Pat. No. 2,290,472, by J. V. Hendrick, issued July 21, 1942, U.S. Pat. No. 2,672,122, by E. J. Kupec et al, issued Mar. 16, 1954, and U.S. Pat. No. 3,863,601, by E. A. Eckart, Jr., issued Feb. 4, 1975. Through the use of adhesive devices or suction cups, these masking shields are self-supporting and do thus not require the presence of the painter's hand at the painting location. However, adhesives and suction cups generally are only usable on glass panes and in other limited circumstances, so that these prior shields at best have only a restricted utility.

The same applies in effect to devices that have been tailored to a particular purpose, such as the mop board protector of U.S. Pat. No. 1,563,889, by F. W. Zastrow, issued Dec. 1, 1925, the shield for wall moldings of U.S. Pat. No. 2,332,579, by C. F. Kirby, issued Oct. 26, 1943, the painter's door shield of U.S. Pat. No. 3,029,782, by B. S. Eure, issued Apr. 17, 1962, and to a large extent also to the work attached paint shield disclosed in U.S. Pat. No. 3,380,435, by E. J. Wagner, issued Apr. 30, 1968.

An interesting situation is apparent from juxtaposition of U.S. Pat. No. 2,545,638, by S. Wheatley, issued Mar. 20, 1951, for a portable paint mask, and U.S. Pat. No. 3,942,472, by E. O. McAlister, issued Mar. 9, 1976. In particular, while the Wheatley renewable paper shield was designed for engagement of a close handle portion by the painter's hand, McAlister provides a similar apparatus with an elongate handle tiltable into various angular positions. Unfortunately, both of these devices are of such complexitiy in design and operation as to be of unlikely widespread use.

A supposedly more practical use is apparent from U.S. Pat. No. 2,289,136, by A. J. Matter, issued July 7, 1942, and showing a painter's masking device with a short handle. Again, that device appears to have been tailored to use at windows and window frames and in other special circumstances.

The paint shield of U.S. Pat. No. 3,528,388, by B. P. McLain, issued Sep. 15, 1970, has a handle spaced from the shield, but is restricted in design to use at roof surfaces. The splash guard of U.S. Pat. No. 3,538,532, by J. P. Shortino et al, issued Nov. 10, 1970, is limited by design to use on paint rollers. The paint guard device of U.S. Pat. No. 4,217,854, by C. E. Brown, issued Aug. 19, 1980, has a convenient way of attaching a handle by means of an internal thread in an edge of the paint shield, receiving a threaded end portion of an elongate handle. In practice, that paint shield would, however, appear to be expensive to manufacture and not suitable for general use, in that it requires the inclusion of crossed sets of multitudes of flexible reforcing elements.

A paint shield particularly made for spray guns is apparent from U.S. Pat. No. 2,842,093, by K. V. O'-Neill, issued July 8, 1958. In practice, that paint shield weighs heavily on the paint gun and would be impractical in many situations. By way of general observation, professional painters are wont to remove or to neglect using safety devices that are complex or tend to interfere with their modus operandi.

Another common observation with painters is their aversion to handling small mechanical devices. Reference may in this respect be had to U.S. Pat. No. 2,484,607, by G. A. Cherem, issued Oct. 11, 1949, and showing a paint guard having an elongate handle attachable thereto at an angle by a nut and bolt combination. In practice, painters usually do not carry a wrench and screwdriver set for satisfactorily servicing such a combination. Also, experience shows that such mechanical devices are easily contaminated by paint or rendered ineffective thereby. The painting shield disclosed in U.S. Pat. No. 4,085,703, by F. J. Glowacki, issued Apr. 25, 1978, somewhat alleviates the latter problem by proposing the use of a wing nut for fastening a tiltable elongate handle. However, a wing nut that projects from the paint shield or shield support may in practice somewhat interfere with the work or at least become stuck when dripping paint is accumulating on the thread of the associated projecting bolt. The paint shield support by Glowacki also employs a pair of clips of the type used in paper clipboards for about a century, as may, for instance, be seen from U.S. Pat. No. 314,769, by H. C. Yeiser, issued Mar. 31, 1985, U.S. Pat. No. 757,937, by W. Lukes, issued Apr. 16, 1904, and U.S. Pat. No. 799,873, by L. Senge, issued Sep. 19, 1905.

Although the structure of the mentioned Glowacki paint shield holder does enable more rapid changing of shield members than typical prior devices, it relies for its gripping action upon a spring-type clip which is essentially mechanical and thereby exposed to contamination by paint, and which engages a retained paint shield along linear edges corresponding in size only to the cross-section of each spring clip body. In consequence, the paint shield comes loose or undesirably changes its position in the holder when the same is bumped, jarred or otherwise rapidly changed in position preparatory to or during painting operations. In practice, the spring tension which can be provided for forcing each spring clip into engagement with a paint shield is limited by the potential danger of accidentally pinching the user's fingers when the paint shield is installed into or removed from the prior holder, necessitating a depression or hand manipulation of the spaced spring clips on the holder. Also in practice, the said limited spring tension of said linear clip practically requires the use of disposable cardboard shield inserts, since heavier or more slippery materials used as shield members in said patented device are held too loosely to fuction either safely or efficiently. As a matter of recent observation, paint shield holders sold under the mentioned Glowacki patent do no longer in structure correspond to the claims thereof. The trend appears to be toward simpler and more straightforward structures as may, for instance, be seen from U.S. Pat. No. Des. 248,725 and U.S. Pat. No. 4,248,914, both by R. A. McClane, issued Aug. 1, 1978 and Feb. 3, 1981, respectively. Unfortunately for the practical painter, however, that design also relies on mechanical nut-and-bolt arrangements for attaching a reinforced paint shield edge to a narrow handle connector.

A currently marketed paint shield for homeowner use combines a rigid blade with a lightweight plastic paint guard and plastic foam handle in an effort to reduce painter fatigue. However, heavier solid straight and angled aluminum shields as well as solid plastic counterparts thereof are currently of most widespread use among professional spray painters. The designs of all of these are such as to practically require the handle to remain permanently attached to the solid shield or shield holder. In practice, however, the presence of a handle at a paint shield or paint shield holder is not always necessary or desirable. Rather, the absence of the handle is often preferable or necessary, while other situations require the availability of selectively attachable and detachable handles of different lengths.

The corner shields and paint spraying methods disclosed in my U.S. Pat. No. 4,331,716, issued May 25, 1982, successfully deal with these problems in many situations, particularly at door frames and similar projecting corners where my paint shields can be suspended, thereby keeping the painter's hand away from the work area, or at corner regions where the painter can hold the shield at a leg thereof remotely from the area of the angled shield where painting is taking place at the moment. While my patented corner shields thus avoid the above mentioned dangers and satisfy the indicated need in many situations, there also exists a need for a paint shield holder which permits a use of paint shields of various dimensions flexibly with or without handles and preferably two or more handles of different lengths, readily exchangeable without a need of nuts, bolts, spring clips or other mechanical contrivances.

Another need which persists is for a paint shield in which migration of paint over an edge portion of the shield from one major surface to the opposite major surface thereof is avoided. Even in spray painting, paint accumulates at an edge portion thereof facing the spray paint gun, as the shield is being used to shield areas adjacent surfaces being painted against the spray paint. In practice, such accumulated paint migrates by gravity capillary action, or otherwise over the solid free edge portion of the paint shield and eventually contaminates the areas which are supposed to be shielded.

A further need exists for a reusable solvent-proof paint shield which is lightweight in comparison with reusable shield members currently available. The combined weight of a solid shield member, holder, handle, and wet paint can be cumbersome and even dangerous, especially during overhead ladder work when the painter may be tired and more prone to becoming unbalanced by hand-maneuvering these contrivances in combination with spray guns, hoses, brushes, or other spray painting equipment.

SUMMARY OF THE INVENTION

It is a general object of this invention to overcome the disadvantages and to meet the needs expressed and implicit in the above disclosure statement and in other parts hereof.

It is a germane object of this invention to provide improved paint shielding systems, methods and equipment.

It is a related object of this invention to provide improved paint shields and paint shield assemblies.

It is also an object of this invention to provide improved methods, apparatus, devices and equipment for holding a paint shield.

Other object of the invention will become apparent in the further course of this disclosure.

From a first aspect thereof, the subject invention resides in a method of holding a paint shield having a planar edge portion, comprising in combination the steps of forming a pair of planar sheets and an interconnecting resilient bight portion into an essentially U-shaped clip for receiving said planar edge portion between major surfaces being in area made a multiple of a cross-section of each planar sheet perpendicular to said major surfaces, employing said resilient clip to bias said planar sheets at said major surfaces into frictional engagement with said planar edge portion, including exerting at said bight portion of said essentially U-shaped clip a gripping action on a lower portion of said planar edge portion and simultaneously retaining said planar edge portion of the paint shield with said sheets of the clip above said bight portion, as seen from said bight portion employing said friction engagement as the only agency at said major surfaces of the planar sheets for holding said planar edge portion in place upon mere manual insertion of the shield at said edge portion into said clip, and providing for said clip an elongate handle rendered selectively attachable to said clip by a manual first relative movement between the elongate handle and the clip, and alternatively detachable from said clip by a manual second relative movement between the elongate handle and the clip.

From another aspect thereof, the subject invention resides in a device for holding a paint shield having a planar edge portion, comprising, in combination, a pair of planar sheets, means for biasing said planar sheets at major surfaces thereof into frictional engagement with said planar edge portion, including a resilient bight portion interconnecting and biasing said planar sheets into said frictional engagement and forming together with said planar sheets an essentially U-shaped clip for receiving said planar edge portion between said major surfaces of the planar sheets, said means for biasing said planar sheet into frictional engagement including means at said bight portion of said essentially U-shaped clip for exerting a gripping action on a lower portion of said planar edge portion, with said frictional engagement being the only agency at said major surfaces of the planar sheets for holding said planar edge portion in place upon mere manual insertion of the shield at said edge portion into said clip, and means on said clip for receiving an elongate handle for said clip, including means for selectively attaching said handle to said clip by a manual first relative movement between the elongate handle and the clip, and alternatively detaching said handle from said clip by a manual second relative movement between the elongate handle and the clip.

From another aspect thereof, the subject invention resides in a method of providing a paint shield assembly, comprising in combination the steps of providing a lightweight, reusable or solvent-proof paint shield having a pair of spaced first planar sheets and interconnecting the sheets with a multitude of mutually spaced webs in the paint shield, providing a pair of spaced second planar sheets smaller than the first planar sheets, manually inserting a portion of the first planar sheets interconnected by the webs in between the second planar sheets, biasing the second planar sheets at major surfaces thereof into frictional engagement with the inserted first planar sheets, and connecting an elongate handle to the second planar sheets for holding the paint shield assembly.

From another aspect thereof, the subject invention resides in a method of painting a surface, comprising the steps of providing a reusable paint shield by interconnecting a pair of planar sheets with a multitude of mutually spaced webs, providing said paint shield with a bifurcated edge portion by cutting said planar sheets along a line spaced from one of said webs interconnecting said planar sheets so that edge portions of both said planar sheets project separately beyond said one web along thereof, holding said paint shield adjacent said surface, and spraying paint past said bifurcated edge portion to said surface thereby shielding against said spraying paint with said held paint shield an area adjacent said surface being painted and preventing with said bifurcated edge portions of the planar sheets a migration of paint over said shielding edge portion of said paint shield to said area.

From another aspect thereof, the subject invention resides in a paint shield assembly, comprising, in combination, a lightweight, reusable paint shield having a pair of spaced first planar sheets interconnected by a multitude of mutually spaced webs, a pair of spaced second planar sheets, means for biasing the second planar sheets at major surfaces thereof into frictional engagement with the first planar sheets, and means at the second planar sheets for receiving an elongate handle for the pair of second planar sheets.

Other aspects of the invention will become apparent in the further course of this disclosure, and no limitation whatever is intended by this summary of the invention in any respect.

BRIEF DESCRIPTION OF THE DRAWINGS

The subject invention and its various objects and aspects will become more readily apparent from the following detailed description of preferred embodiments thereof, illustrated by way of example in the accompanying drawings, in which.

DESCRIPTION OF PREFERRED EMBODIMENTS

Figure 1:
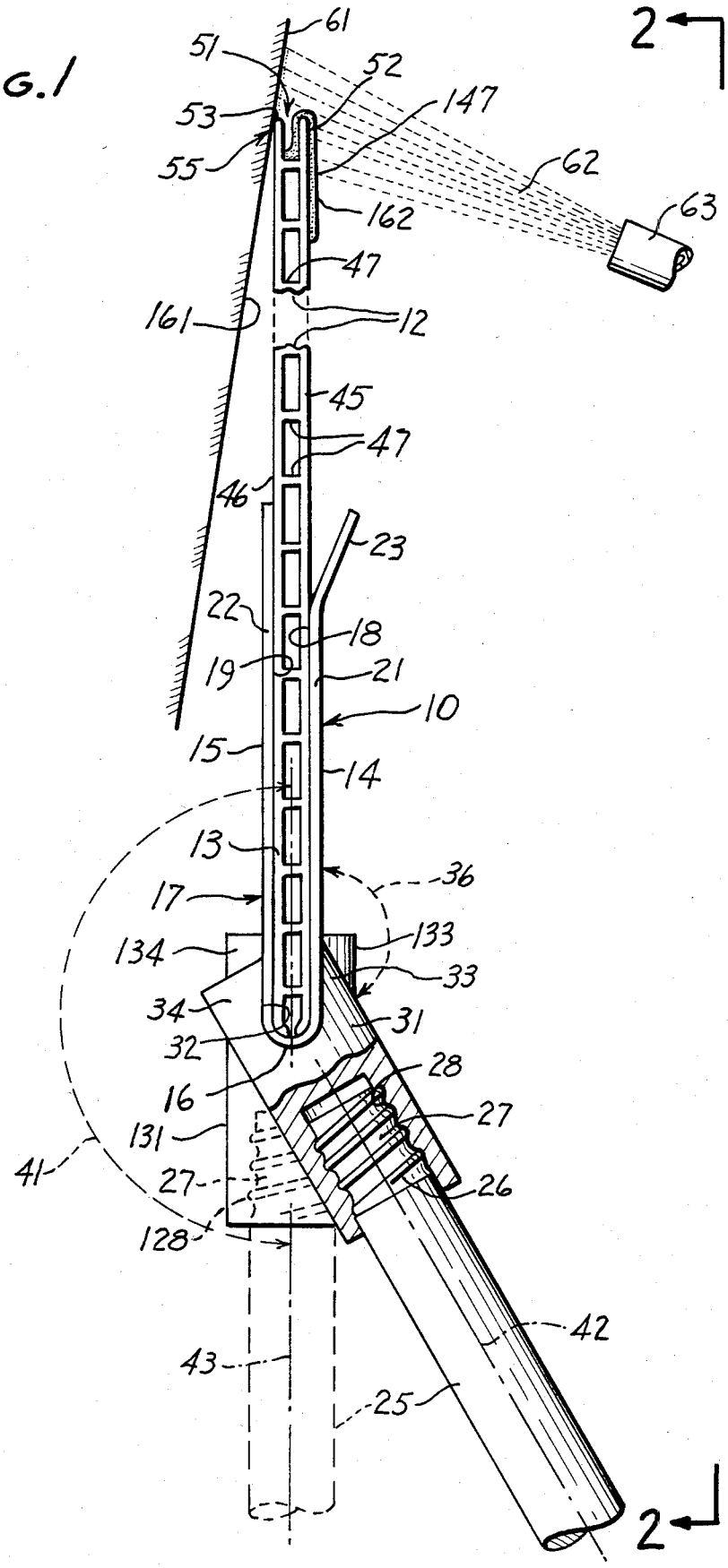
FIG. 1 is a side view of a paint shield assembly according to a preferred embodiment of the subject invention, with adjacent structure.

According to one aspect thereof, the accompanying drawings show a method or device 10 for holding a paint shield 12 having a planar edge portion 13. This aspect of the invention forms a pair of planar sheets 14 and 15 and an interconnecting resilient bight portion into an essentially U-shaped clip 17 for receiving the planar edge portion 13 of the shield between major surfaces 18 and 19 being in area made a multiple of a cross-section 21, 22 of each planar sheet 14, 15 perpendicular to the major surfaces 18 and 19. The bight portion 16 or resilient clip 17 is employed to bias the planar sheets 14 and 15 at the major surfaces 18 and 19 into frictional engagement with the planar edge portion 13 of the shield 12.

The illustrated preferred embodiment thus includes means for biasing the planar sheets 14 and 15 at major surfaces 18 and 19 thereof into frictional engagement with the planar edge portion 13, including a resilient bight portion 16 interconnecting and biasing the planar sheets into the mentioned frictional engagement and forming together with such planar sheets 14 and 15 a clip 17 for receiving the planar edge portion 13 between the major surfaces 18 and 19 of the planar sheets 14 and 15.

According to the currently discussed aspect of the subject invention, the latter frictional engagement is employed as the only agency at the major surfaces 18 and 19 of the planar sheets 14 and 15 for holding the planar edge portion 13 and thereby the paint shield 12 in place upon mere manual insertion of the shield at its edge portion 13 into the clip 17 or in between the planar sheets 14 and 15.

The major surfaces 18 and 19 frictionally engaging the planar edge portion 13 are made sufficiently large to hold the paint shield with such frictional engagement alone at the planar edge portion in the clip 17 or between the sheets 14 and 15 against gravitational forces in any position of the device or holder 10.

In this manner, the drawbacks of prior-art nut and bolt arrangements and similar mechanical fastening devices are elegantly avoided, for the benefit and convenience of the painter.

The planar sheets 14 and 15 and the bight portion 16 are preferably made in one piece. By way of example, the clip 17 may be formed by bending a piece of metal over a rod. Alternatively, a thermoplastic or thermosetting resin or plastic may be employed for forming the clip 17 by injection molding or otherwise. For instance, a sheet of an acrylic resin, polypropylene, polyethylene, or acrylonitrile-butadiene-styrene (ABS) may be bent, such as over a heated rod, in order to form the clip 17 with the planar sheets 14 and 15 and bight portion 16.

As illustrated in FIG. 1, at least one of the planar sheets 14 and 15, such as the planar sheet 14, is provided with an outwardly slanted lip 23 for facilitating insertion of the planar edge portion 13 of the shield into the clip 17. If desired, the sheets 14 and 15 may be provided along corresponding edges with a pair of slanted lips diverging outwardly from each other. However, one outwardly slanted lip 23 on either sheet 14 or 15 will generally be sufficient for facilitating insertion of the lower paint shield portion into the clip 17.

The outwardly slanted lip 23 is preferably formed in one piece with the planar sheets 14 and 15 and the resilient bight portion 16. For instance, the lip 23 may be formed by bending an upper portion of the sheet 14 outwardly, as seen from the sheet 15.

Figure 2:
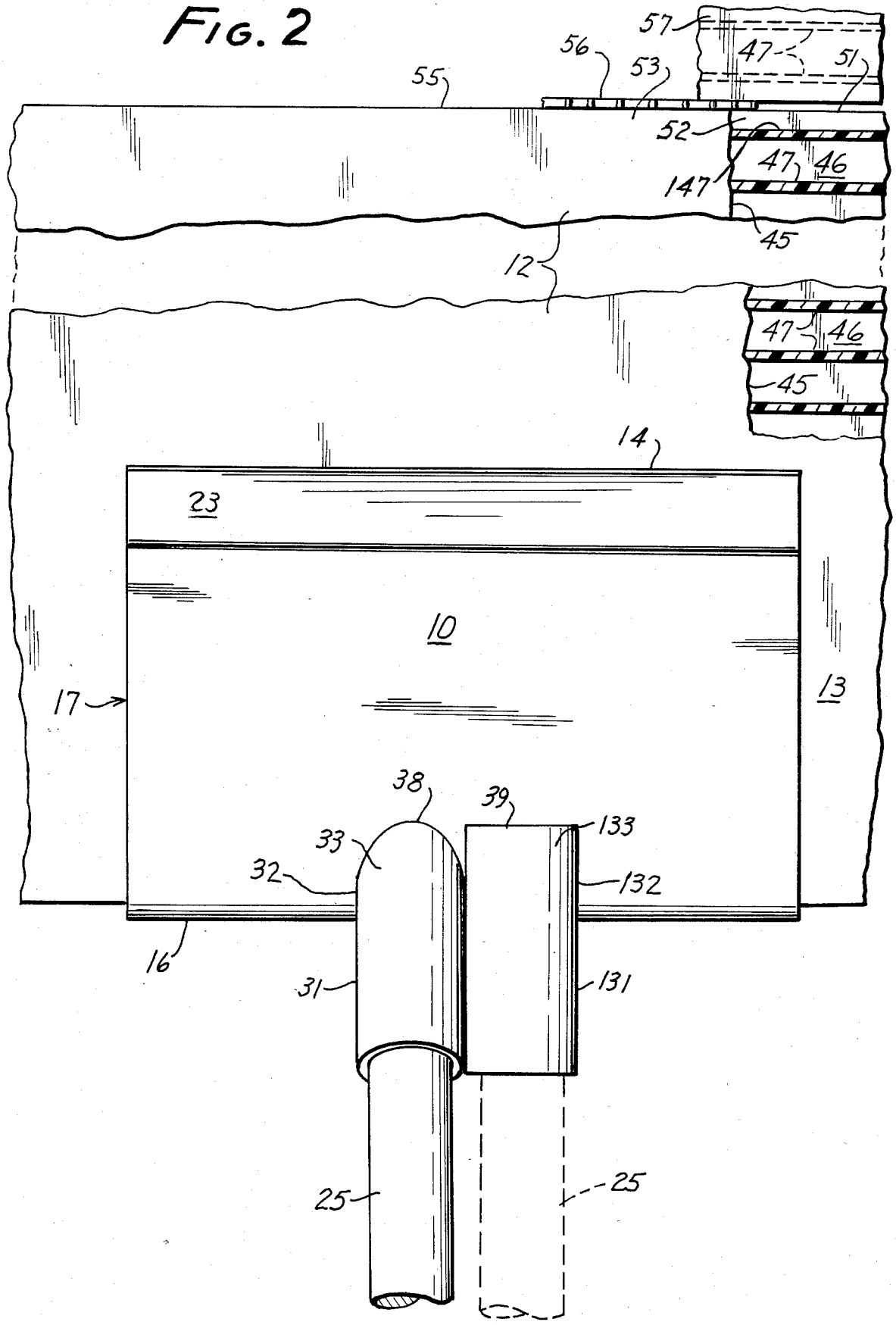
FIG. 2 is a view in the direction of the arrow 2 in FIG. 1, together with a showing, at the top of FIG. 2, of a method of providing the illustrated paint shield with a paint migration barrier, according to another preferred embodiment of the subject invention.

As seen in FIGS. 1 and 2, an elongated handle 25 is provided for the clip 17. In contrast to some of the above mentioned prior approaches, the elongate handle 25 is rendered selectively attachable to the clip 17 by a manual first relative movement between the elongate handle and the clip, and is alternatively detachable from the clip by a manual second relative movement between the elongate handle 25 and the clip 17. In practice, this may, for instance, be accomplished by providing an end portion 26 of the handle 25 with a first thread 27 and equipping the clip 17 with a second thread 28 for receiving the first thread 27 in meshing engagement.

According to the illustrated preferred embodiment of the invention, at least one nipple 31 is provided for receiving an end portion 26 of the handle 25. Such nipple may be internally threaded, as shown at 28, if the handle 25 has a threaded end portion 27.

The nipple 31 is provided with a notch 32 for receiving the resilient bight portion 16 or clip 17. Such resilient bight portion 16 or clip 17 may be permanently fitted into the notch 32 of the nipple 31. In this manner, the resilient bight portion 16 or clip 17 is restrained against outward expansion with portions 33 and 34 of the nipple 31 at its notch 32. The notched nipple may thus be viewed or act as a rigid jaw restraining the resilient bight portion 16 or clip 17 between its upper portions 33 and 34.

In practice, this, in turn, exerts a certain grip on the lower portion of the inserted paint shield, thereby safeguarding same against inadvertent dislodgment in the clip 17.

The illustrated nipple 31 is positioned so as to render the elongate handle 25 selectively attachable to the clip 17 at a first angle 36 relative to the clip 17 or sheets 14, 15. In the illustrated preferred embodiment of the invention, the elongate handle 25 is also rendered selectively attachable to the clip 17 or sheets 14, 15 at a second angle 41 relative to the clip 17 or sheets 14, 15. In the illustrated embodiment, the first angle 36 is 150° and the second angle 41 is 180°. However, this need not necessarily be the case, as long as the second angle 41 is different in amount from the first angle 36, rather than being just different in direction.

In this manner, the painter is provided with a facility for changing the angle between handle and paint shield in a convenient and effective manner, without any actuation of nut and bolt arrangements, wing nuts or similar adjustment of mechanical parts.

The illustrated embodiment of the invention has a second nipple 131 supplementing the first nipple 31 as a means on the clip 17 or bight portion 16 for receiving the elongate handle 25 at an angle different in amount from the angle 36. In the illustrated embodiment of the invention, the amount of different angle between the first nipple 31 and the second nipple 131 is 30°.

However, angles other than that may be chosen when designing the paint shield holder 10, as long as the second angle with which the handle is alternatively attached is different in amount from the first angle 36, rather than just being different in direction.

In this or any equivalent manner within the scope of the currently discussed aspect of the invention, the elongate handle 25 is rendered selectively attachable to the clip 17 at a first location 38, seen in FIG. 2, wherein the clip extends at a first angle 36, seen in FIG. 1, to the elongate handle 25, and such or a substitute elongate handle is also rendered selectively attachable to the clip at a second location 39 spaced from the first location 38, as seen in FIG. 2, wherein the clip extends at a second angle 41 different in amount from the first angle 36, such as by 30° or otherwise.

As before, an end portion 26 of the handle 25 may be provided with a first thread 27, the clip 17 may be provided with a second thread 28, such as via a nipple 31, encompassing a first axis of rotation 42 extending at a first angle 36 to the clip for receiving the first thread 27 in meshing engagement, with the elongate handle 25 then extending at the first angle 36 relative to the clip 17 or sheets 14, 15. In the illustrated embodiment of the invention, the clip 17 is equipped with a third thread 128 encompassing a second axis of rotation 43 extending at a second angle 41 to the clip different in amount from the first angle 36, for alternatively receiving the first thread 27 in meshing engagement. As seen in FIGS. 1 and 2, the angles 36 and 41 are fixed angles.

In this manner, the elongate handle 25 or substitute thereof extends at the different second angle 41.

As the nipple 31, the nipple 131 may be provided with a notch which is similar to the notch 32 shown in FIG. 1, but is indicated in location at 132 in FIG. 2, for receiving the resilient bight portion 16 or the clip 17. As before, the resilient bight portion is fitted into the notch at 132 of the nipple 131, and such fitted resilient bight portion 16 or the sheets 14, 15 or the clip 17 are restrained against outward expansion with portions 133 and 134 of the nipple 131 at the notch 132, acting like a rigid jaw and thereby exerting holding power on the lower portion 13 of the inserted paint shield 12. The notched nipples 31 and 131 are preferably solvent-welded or otherwise permanently attached over the central region of the bight portion 16.

In terms of the illustrated paint shield assembly and equivalents thereof within the scope of an aspect of the subject invention, the paint shield 12 is provided with a pair of first solvent-proof planar sheets 45 and 46 interconnected with a multitude of mutually spaced webs 47. Such reusable and lightweight paint shield 12 with its spaced webs 47 supporting sheets 45 and 46 in mutually spaced relationship may, for instance, be formed by extruding a plastic material, such as polyethylene or polypropylene, or another solvent-resistant material that will be self-supporting when formed into the paint shield 12.

Against this background, it may be said that the illustrated embodiment of the subject invention also provides a pair of second planar sheets, such as the previously described sheets 14 and 15, and biases such second planar sheets 14 and 15 at major surfaces 18 and 19 thereof into frictional engagement with the first planar sheets 45 and 46, respectively, of the inserted paint shield 12. The nipple 31, with or without further nipple 131, or equivalents thereof, may then be viewed as means at the second planar sheets 14, 15 for receiving an elongate handle 25 for such pair of second planar sheets.

As before, the mentioned frictional engagement of the first and second planar sheets 14 and 15 and 45 and 46, respectively, preferably is the only agency at the major surfaces 18 and 19 of the second planar sheets 14, 15 for holding the portion 13 of the first pair of planar sheets 45, 46 in place upon mere manual insertion of the shield 12 at its portion 13 in between the second planar sheets 14, 15.

The requisite biasing means may again include a resilient bight portion 16 interconnecting and biasing the second planar sheets 14, 15 into their frictional engagement and forming together with the second planar sheets a clip 17 for receiving a portion of the first planar sheets 45, 46 interconnected by the webs 47.

Numerous tests have confirmed that the illustrated cellular paint shield structure and equivalents thereof are particularly well received and safely maintained in the clip 17 and equivalents thereof within the scope of the invention, and that celluarly structured polyethylene or polypropylene materials are significantly lighter in weight per square foot of shielding surface than currently manufactured reusable paint shields composed of solid metal or plastic materials.

As seen in FIG. 1 inside the bottom of the clip 17, downwardly projecting portions of the spaced sheets 45 and 46 may resiliently bend inwardly when the paint shield 12 is inserted into the clip 17, thereby aiding the retention of the shield in the clip against gravitational forces and jarring in different positions of the paint shield assembly.

At the top of shielding edge 55 of the paint shield 12, the illustrated preferred embodiment of the subject invention provides the paint shield with a channel or barrier 51 to prevent paint migration over the edge of the paint shield from one to the other of the spaced first planar sheets 45, 46. In this respect, migration of paint to a shielded surface has been and continues to be a frequent problem with conventional paint shields, since paint migrating over the shielding edge of a conventional paint shield during use thereof will quickly contaminate an area that is supposed to have been shielded.

According to a further aspect of the subject invention, such migration of paint is avoided or at least considerably delayed by the provision of a channel or barrier 51 at the shielding edge 55 of the cellular paint shield, such as the illustrated top edge thereof.

According to the illustrated embodiment of the subject invention, the shielding edge 55 of the paint shield 12 is provided with the paint migration barrier or channel 51 by providing the first planar sheets 45 and 46 with bifurcated edge portions 52 and 53 projecting separately beyond one of the webs 47, such as beyond a top web 147.

The rectangular bifurcation configuration shown in the illustrated embodiment is preferred to maximize the effective space within the paint migration barrier or channel 51, which serves to contain wet paint migrating over the shielding edge portion 52 of planar sheet 45.

Regular rectangular spacing of the flutes or webs 47 enables the disclosed channel or paint migration barrier 51 with bifurcated shielding edge portions 52, 53, to be cut as desired. The said edge portions 52, 53 must also be of sufficient rigidity or resilience that they are not crushed or collapsed permanently together when subjected to cutting procedures, or to other strains and stresses during paint shield use.

Of pertinence to this considered aspect is the fact that commonly employed disposable paint shields composed of corrugated cardboard material do not provide such a bifurcated channel or paint migration barrier. In fact, the shielding edge of cardboard paint shields is in practice cut across the flute or corrugation direction to provide reinforcing strength to maintain as straight an edge as is possible with that material, thereby exposing the flutes to wet paint migration. Cardboard material cut in the opposite direction, along the flutes, squashes together along its edges due to lack of reinforcement, and the edge flaps are thereby either partially or wholly sealed shut. Also, cardboard is not provided with evenly-spaced webs or flutes; rather, the closely knit webs of cardboard material are angled and sometimes even bent with respect to their junctions at the opposite sides of the cardboard sheet, and these also interfere with the desired channel formation.

As somewhat schematically illustrated in FIG. 2, the paint shield 12 may be provided with a bifurcated edge portion 55 opposite the second planar sheets 14, 15 by cutting the first planar sheets 45, 46 along a line 56 spaced from one of the webs 147 interconnecting the first planar sheets 45, 46 so that edge portions 52 and 53 of the first planar sheets 45 and 46, respectively, project separately beyond the one web 147 along thereof. In practice, a circular or other saw, a brake press, shears, or another cutting tool or method, may be employed for cutting off a portion 57 of the paint shield blank, so as to provide the shield with the paint migration barrier or channel 51 along a top shielding edge 55 thereof.

No claim is made for the paint shield 12 per se which may, for instance, be cut from an extruded sheet of cellular high-density polypropylene or other plastic material. However, I do claim protection for the combination of the paint shield 12 with the clip 17 or equivalent paint shield holder as disclosed above and set forth in corresponding accompanying claims.

I also claim a novel method of painting a surface 61 of a ceiling, wall or other structure, which method includes the steps of providing a lightweight and reusable paint shield 12 by interconnecting a pair of solvent-proof planar sheets 45, 46 with a multitude of mutually spaced webs 47, providing that paint shield with a bifurcated edge portion 55 by cutting the planar sheets 45, 46 along a line 56 spaced from one of the webs 147 interconnecting the planar sheets, so that separated edge portions 52 and 53 of the planar sheets 45, 46 project separately beyond that one web 147 along thereof.

This method also includes the steps of holding the paint shield 12 thus prepared adjacent to the surface 61 and spraying paint 62 past such paint shield edge portion to the surface 61, thereby shielding against the spraying paint 62 with the held paint shield 12 an area 161 adjacent the surface 61 being painted and preventing with the bifurcated edge portion 55 or separated portions 52 and 53 of the planar sheets a migration of paint 161 over the shielding edge of the paint shield to the shielded area 161.

As seen by way of example in FIG. 1, a paint deposit 162 accumulates on the paint shield surface or sheet 45 facing the painter or the spray gun 63, when paint 62 is sprayed therefrom against a surface 61 having an adjacent area or structure 161 protected against spray paint by the shield 12. In the course of a paint job, the accumulating paint deposit 162 tends to migrate over the edge of a conventional shield, thereby smearing or otherwise contaminated an area 161 that is supposed to remain shielded.

By providing the paint migration barrier 51 as shown in the drawings, the illustrated aspect of the subject invention substantially inhibits a migration of such paint deposit to the side of the paint shield or sheet 46 facing away from the painter or spray gun, by trapping said paint deposit in the space or channel 51 between the top edges 52 and 53 of the sheets bifurcated edge portion 55 and the uppermost interconnecting web 147.

The painting method with migrating paint barrier may also be employed with paint shields not having the clip 17 attached thereto.

By way of example, the paint shields and shielding methods with migrating paint barrier may advantageously be employed in the spray shields and spraying methods of my above mentioned U.S. Pat. No. 4,331,716, issued May 25, 1982 and hereby incorporated by reference herein.

On the other hand, the resilient clip or holder 17 may be employed without a handle 25. In that case, the clip 17 may, for instance, simply be held by the painter's hand which is thereby kept at a safe distance from the paint spray 62. This embodiment of the subject invention, without its readily attachable handle 25, is thus readily able to shield, for instance, a concrete driveway adjacent to an exterior stucco wall, or to perform close-quarter shielding of interior door frames without the inconvenience of a handle which is permanently attached or is otherwise difficult to remove.

In conjunction with the paint migration barrier or channel 51 of the paint shield 12, the use of the shielding sheet 45 as a paint palette is particularly advantageous during spray painting operations, when canisters of paint are not normally carried by the painter. The shielding sheet 45 serves as a ready source of wet paint to brush-fill cracks or to cut-in boundaries where the shield 12 cannot fit or reach.

The capability to brush up accumulated wet paint 162 from the sheet 45 without interruption of work to clean the shield favorably distinguishes the disclosed paint migration barrier 51 of the shield 12 from other shielding methods. A conventional reusable shield having a solid edge must be periodically cleaned methodically on and near its shielding edge. Cardboard paint shields, on the other hand, cannot even be cleaned; they soak in the wet paint, and their shielding edge flutes become soggy and weak, ultimately disintegrating or warping irrepairably.

Further variations or modifications within the spirit and scope of the subject invention are readily suggested or rendered apparent to those skilled in the art by the subject extensive disclosure and equivalents thereof.

I claim:

1. A method of holding a paint shield having a planar edge portion, comprising in combination the steps of:

forming a pair of planar sheets and an interconnecting resilient bight portion into an essentially U-shaped clip for receiving said planar edge portion between the major surfaces of said planar sheets;

employing said resilient clip to bias said planar sheets at said major surfaces into frictional engagement with said planar edge portion, including exerting at said bight portion of said essentially U-shaped clip a gripping action on a lower portion of said planar edge portion and simultaneously retaining said planar edge portion of the paint shield with said sheets of the clip above said bight portion, as seen from said bight portion;

employing said frictional engagement as the only agency at said major surfaces of the planar sheets for holding said planar edge portion in place upon mere manual insertion of the shield at said edge portion into said clip; and Providing for said clip an elongate handle rendered selectively attachable to said clip by a manual first relative movement between the elongate handle and the clip, and alternatively detachable from said clip by a manual second relative movement between the elongate handle and the clip.

2. A method as claimed in claim 1, including the step of:

forming said pair of planar sheets and said resilient bight portion in one piece.

3. A method as claimed in claim 1, including the step of:

providing at least one of said planar sheets with an outwardly slanted lip for facilitating insertion of said planar edge portion into said clip.

4. A method as claimed in claim 3, including the step of:

forming said pair of planar sheets, said outwardly slanted lip and said resilient bight portion in one piece.

5. A method as claimed in claim 1, including the steps of:

providing an end portion of said handle with a first thread; and equipping said clip with a second thread for receiving said first thread in meshing engagement.

6. A method as claimed in claim 1, including the steps of:

rendering said elongate handle selectively attachable to said clip at a first angle relative to said clip; and rendering said elongate handle selectively attachable to said clip at a second angle relative to said clip different in amount from said first angle.

7. A method as claimed in claim 1, including the steps of:

rendering said elongate handle selectively attachable to said clip at a first location wherein said clip extends at a fixed first angle to said elongate handle; and rendering said elongate handle selectively attachable to said clip at a second location spaced from said first location wherein said clip extends at a fixed second angle to said elongate handle being different in amount from said first angle.

8. A method as claimed in claim 1, including the steps of:

providing an end portion of said handle with a first thread;

equipping said clip with a second thread encompassing a first axis of rotation extending at a first angle to said clip for receiving said first thread in meshing engagement, with said elongate handle extending at said first angle; and equipping said clip with a third thread encompassing a second axis of rotation extending at a second angle to said clip different in amount from said first angle for alternatively receiving said first thread in meshing engagement, with said elongate handle extending at said different second angle.

9. A method as claimed in claim 1, wherein:

said major surfaces frictionally engaging said planar edges portion are made sufficiently large to hold the paint shield with said frictional engagement alone at said planar edge portion in said clip against gravitational forces in any position of said device.

10. A method as claimed in claim 1, including the step of:

providing a nipple for receiving an end portion of said handle;

providing said nipple with a notch for receiving said resilient bight portion;

fitting said resilient bight portion into said notch of the nipple; and providing said notched nipple as a rigid jaw restraining said resilient bight portion of said essentially U-shaped clip against outward expansion at said notch during said exertion of a gripping action on a lower portion of said planar edge portion.

11. A device for holding a paint shield having a planar edge portion, comprising in combination:

a pair of planar sheets;

means for biasing said planar sheets at major surfaces thereof into frictional engagement with said planar edge portion, including a resilient bight portion interconnecting and biasing said planar sheets into said frictional engagement and forming together with said planar sheets an essentially U-shaped clip for receiving said planar edge portion between said major surfaces of the planar sheets, said means for biasing said planar sheet into frictional engagement including means at said bight portion of said essentially U-shaped clip for exerting a gripping action on a lower portion of said planar edge portion, with said frictional engagement being the only agency at said major surfaces of the planar sheets for holding said planar edge portion in place upon mere manual insertion of the shield at said edge portion into said clip; and means on said clip for receiving an elongate handle for said clip, including means for selectively attaching said handle to said clip by a manual first relative movement between the elongate handle and the clip, and alternatively detaching said handle from said clip by a manual second relative movement between the elongate handle and the clip.

12. A device as claimed in claim 11, wherein:

said pair of planar sheets and said resilient bight portion form said clip in one piece.

13. A device as claimed in claim 11, including:

an outwardly slanted lip extending along a corresponding edge of one of said planar sheets for facilitating insertion of said planar edge portion into said clip.

14. A device as claimed in claim 11, wherein:

said means for selectively attaching said handle include a first thread on an end of said handle, and a second thread for receiving said first thread in meshing engagement.

15. A device as claimed in claim 11, wherein:

said means for selectively attaching said handle include means for selectively attaching said handle to said clip at a first angle relative to said clip, and means for alternatively attaching said handle to said clip at a second angle relative to said clip different in amount from said first angle.

16. A device as claimed in claim 11, wherein:

said means for selectively attaching said handle include means at a first location on said clip for selectively attaching said handle to said clip at a first fixed angle to said clip, and means at a second location spaced from said first location for alternatively attaching said handle to said clip at a second fixed angle different in amount from said first angle.

17. A device as claimed in claim 11, wherein:

said means for selectively attaching said handle include a first thread on an end portion of said handle, a second thread at said clip encompassing a first axis of rotation extending at a first angle to said clip for receiving said first thread in meshing engagement for extension of said handle at a first angle, and a third thread at said clip encompassing a second axis of rotation extending at a second angle to said clip for receiving said first thread in meshing engagement for extension of said handle at a second angle different from said first angle.

18. A device as claimed in claim 11, wherein:
said major surfaces frictionally engaging said major edge portion are sufficently large to hold the paint shield with said frictional engagement alone at said planar edge portion in said clip against gravitational forces in any position of said device.

19. A device as claimed in claim 11, wherein:
said means for receiving an elongate handle include a nipple for receiving an end portion of said handle;
said bight portion being fitted into a portion of said nipple and
said portion of said nipple including a rigid jaw for restraining said resilient bight portion against outward expansion during said exertion of a gripping action on a lower portion of said planar edge portion.

20. A method of providing a paint shield assembly, comprising in combination the steps of:
providing a paint shield with a pair of spaced first planar sheets and interconnecting said sheets with a multitude of mutually spaced webs in said paint shield;
providing a pair of spaced second planar sheets smaller than said first planar sheets;
manually inserting a portion of said first planar sheets interconnected by said webs in between said second planar sheets;
biasing said second planar sheets at major surfaces thereof into frictional engagement with said inserted first planar sheets; and
connecting an elongate handle to said second planar sheets for holding said paint shield assembly.

21. A method as claimed in claim 20, wherein:
said frictional engagement is the only agency at said major surfaces of the second planar sheets for holding said portion of the first pair of planar sheets in place upon mere manual insertion of the shield at said portion in between said second planar sheets.

22. A method as claimed in claim 20, including the steps of:
selectively connecting said handle to said second planar sheets at a first angle thereto; and
alternatively connecting said handle to said second planar sheets at a second angle thereto different in amount from said first angle.

23. A method as claimed in claim 20, including the step of:
providing said paint shield with a barrier against paint migration over an edge of said paint shield from one to the other of said spaced first planar sheets, by providing said first planar sheets with bifurcated edge portions projecting separately beyond a proximal web along thereof.

24. A method as claimed in claim 20, including the step of:
providing said paint shield with a bifurcated edge portion opposite said second planar sheets by cutting said first planar sheets along a line spaced from one of said webs interconnecting said first planar sheets so that edge portions of said first planar sheets project separately beyond said one web along thereof.

25. A method of painting a surface, comprising the steps of:
providing a paint shield by interconnecting a pair of planar sheets with a multitude of mutually spaced webs;
providing said paint shield with a bifurcated edge portion by cutting said planar sheets along a line spaced from one of said webs interconnecting said planar sheets so that edge portions of said planar sheets project separately beyond said one web along thereof;
holding said paint shield adjacent said surface; and
spraying paint past said bifurcated edge portion to said surface thereby shielding against said spraying paint with said held paint shield an area adjacent said surface being painted and preventing with said bifurcated edge portions of the planar sheets a migration of paint over said edge portion of said paint shield to said area.

26. A paint shield assembly, comprising in combination:
a paint shield having a pair of spaced first planar sheets interconnected by a multitude of mutually spaced webs;
a pair of spaced second planar sheets;
means for biasing said second planar sheets at major surfaces thereof into frictional engagement with said first planar sheets; and
means at said second planar sheets for receiving an elongate handle for said pair of second planar sheets.

27. A paint shield assembly as claimed in claim 26, wherein:
said frictional engagement is the only agency at said major surfaces of the second planar sheets for holding said portion of the first pair of planar sheets in place upon mere manual insertion of the shield at said portion in between said second planar sheets.

28. A paint shield assembly as claimed in claim 26, wherein:
said biasing means include a resilient bight portion interconnecting and biasing said second planar sheets into said frictional engagement and forming together with said second planar sheets a clip for receiving a portion of said first planar sheets interconnected by said webs.

29. A paint shield assembly as claimed in claim 28, wherein:
said means for receiving said handle include means at a first location on said clip for selectively attaching said handle to said clip at a first angle to said clip, and means at a second location spaced from said first location for alternatively attaching said handle to said clip at a second angle different in amount from said first angle.

30. A paint shield assembly as claimed in claim 26, including:
a barrier against paint migration over an edge of said paint shield from one to the other of said spaced planar sheets, including bifurcated edge portions of said first planar sheets projecting separately beyond the proximal web along thereof.

* * * * *